US006524173B1

(12) United States Patent
Nelson et al.

(10) Patent No.: US 6,524,173 B1
(45) Date of Patent: Feb. 25, 2003

(54) SURFACE CLEANING APPARATUS

(76) Inventors: Marc O. Nelson, 14061 92nd Pl. North, Maple Grove, MN (US) 55369; Earl E. Martens, 10085 99th Ave. North, Maple Grove, MN (US) 55369

( * ) Notice: Subject to any disclaimer, the term of this patent is extended or adjusted under 35 U.S.C. 154(b) by 0 days.

(21) Appl. No.: 09/906,569

(22) Filed: Jul. 16, 2001

Related U.S. Application Data

(63) Continuation of application No. 09/397,464, filed on Sep. 16, 1999, now Pat. No. 6,260,232.
(60) Provisional application No. 60/101,276, filed on Sep. 22, 1998.

(51) Int. Cl.[7] ..... B24B 7/00
(52) U.S. Cl. ..... 451/178; 451/449; 451/456; 451/547
(58) Field of Search ..... 451/178, 449, 451/450, 456, 523, 524, 525, 541, 547

(56) References Cited

U.S. PATENT DOCUMENTS

| | | | | | |
|---|---|---|---|---|---|
| 1,575,939 | A | | 3/1926 | Satterwhite et al. | |
| 1,601,774 | A | | 10/1926 | Scheffer | |
| 2,240,005 | A | | 4/1941 | Moyer | |
| 2,506,077 | A | | 5/1950 | Goldsmith | |
| 2,548,923 | A | * | 4/1951 | Walters | 15/200 |
| 2,949,620 | A | | 8/1960 | Noble | |
| 3,258,809 | A | | 7/1966 | Harvey | |
| 3,281,885 | A | | 11/1966 | Hersh | |
| 3,783,473 | A | | 1/1974 | Engquist | |
| 3,829,019 | A | | 8/1974 | Petsch | |
| 4,207,998 | A | | 6/1980 | Schmid | |
| 4,282,626 | A | | 8/1981 | Schneider | |
| 4,646,480 | A | * | 3/1987 | Williams | 51/424 |
| 4,833,752 | A | | 5/1989 | Merrick | |
| 5,343,591 | A | | 9/1994 | Clark | |
| 5,428,865 | A | * | 7/1995 | Yarbrough | 15/353 |
| 5,527,212 | A | * | 6/1996 | Bowen et al. | 451/456 |
| 5,540,616 | A | * | 7/1996 | Thayer | 451/354 |
| 5,545,080 | A | * | 8/1996 | Clowers et al. | 451/354 |
| 5,690,545 | A | * | 11/1997 | Clowers et al. | 15/28 |
| 6,019,545 | A | * | 2/2000 | Allen et al. | 404/112 |
| 6,021,545 | A | | 2/2000 | Delgado et al. | |
| 6,323,570 | B1 | * | 11/2001 | Nishimura et al. | 15/392 |
| 6,347,985 | B1 | * | 2/2002 | Loveless | 451/354 |

* cited by examiner

*Primary Examiner*—Timothy V. Eley
*Assistant Examiner*—Alvin J. Grant

(57) ABSTRACT

An apparatus for cleaning a surface has a handle joined to a cleaning head operable to dispense liquid onto a surface to be cleaned, mechanically work up dirt, film and particulates from the surface into a vacuum unit. The cleaning head has a cylindrical core supporting a scrubber that rotates on a cylindrical member as the head moves relative to the surface to be cleaned. Nozzles located within the cleaning head discharge liquid into the core and scrubber. The scrubber has helical abrasive and porous ribbons that horizontally and laterally scrub and distribute the liquid onto the surface to be cleaned. A modification of the apparatus has nozzles located adjacent the scrubber that dispenses liquid to a surface. The scrubber when subjected to vacuum picks up the liquid and dirt from the surface.

48 Claims, 7 Drawing Sheets

SURFACE CLEANING APPARATUS

This application is a continuation of application Ser. No. 09/397,464, filed Sep. 16, 1999, now U.S. Pat. No. 6,260, 232, which claims the benefit of Provisional application Ser. No. 60/101,276, filed Sep. 22, 1998.

FIELD OF THE INVENTION

The invention is in the field of surface cleaning devices that dispense cleaning liquids on the surface and extracts with vacuum the cleaning liquids, dirt, dust, and particulates from the surface.

BACKGROUND OF THE INVENTION

Conventional fluid pressure cleaning equipment utilize manually operated cleaners that dispense liquids, including water, onto the surface of floors and walls and mechanically scrub the surfaces. These cleaners have housings connected to elongated handles used by work persons to move the housing relative to the surface to be cleaned. Spinners having nozzles rotatably mounted on the housing discharge cleaning liquid onto the surface. Brushes attached to the housing are used to mechanically scrub the surfaces. The cleaning liquid is spread over the surface and in time evaporates. An example of this type of cleaning equipment is disclosed by H. A. Petsch in U.S. Pat. No. 3,829,019.

Cleaning devices having vacuum cleaner heads including nozzles to discharge water onto the surface to be cleaned are disclosed by H. W. Schneider in U.S. Pat. No. 4,282,626. Brushes are used on the cleaner heads to mechanically scrub the surface.

C. F. Scheffer in U.S. Pat. No. 1,601,774 discloses a vacuum tool for cleaning carpets and rugs. The tool has a tubular handle secured at its lower end to a yoke. A tubular cylinder having suction apertures is rotatably mounted on the yoke. Air drawn through the apertures picks up dirt-and dust as the cylinder rolls over the carpet and rug. The tool does not dispense a liquid or cleaning material on the carpet or rug.

J. W. Noble in U.S. Pat. No. 2,949,620 discloses a floor mopping machine having a tubular handle connected with a hose to a vacuum device. The lower end of the handle is connected to a pair of U-shaped tubes which rotatably support a roller. The tubes have holes that discharge liquid into the roller and porous sleeve on the roller. The liquid and dirt in the sleeve is drawn with a vacuum out of the sleeve into the handle with a shoe that is moved into engagement with the sleeve. A vacuum is not used inside the roller to pick up liquid and dirt from the surface and transfer the liquid and dirt into the roller. A ratchet on a tube and roller limits rotation of the roller in one direction relative to the surface to be cleaned to wipe the surface and soak liquid into the porous sleeve.

SUMMARY OF THE INVENTION

The surface cleaner of the invention has a cleaning head that dispenses a cleaning liquid onto a surface to be cleaned to wet and dissolve foreign materials, such as dirt, dust, film, molds, oils, grease, bacteria, fungi, pollen, and particulates on the surface, mechanically horizontally and laterally scrub the surface, and remove with vacuum liquid and foreign materials from the surface. The surfaces include building walls, windows, floors, vehicles, and objects having surfaces that are cleaned. Heating, ventilating, and air conditioning equipment can be cleaned to remove dust, dirt, bacterial, and fungal growth with the cleaner of the invention. The cleaner has a cleaning head that includes a cylindrical member accommodating a rotatable core supporting a porous sleeve that rotates as it is moved relative to a surface to be cleaned. An elongated tubular handle connected to the cleaning head is used by the work person to move the cleaning head. The handle is connected to a vacuum unit with a hose that transports air, liquid and foreign materials from the cleaning head to the vacuum unit. A pump operates to deliver cleaning liquid, such as water, to a flexible tube located in the handle and connected to a tube within the cleaning head. Nozzles dispense cleaning liquid into the sleeve which spreads the liquid on to the surface to be dispensed on the surface to be cleaned and permit the vacuum to pick up liquid, film and dirt from the surface leaving the surface dry and clean. The sleeve has a porous rigid cylinder attached to fabric, plastic fibers, felt, abrasives, chamois, and rubber like materials. The sleeve has an external helical ribbon of abrasive or scrubbing material, such as a rigid plastic fibers, located about porous material that picks up dirt and liquid from a surface. The ribbon of abrasive material spreads the liquid on the surface and horizontally and laterally scrubs the surface during rotation of the sleeve to loosen dirt and particulates therefrom. The cleaning head effectively cleans the surface without injecting liquid sprays into the atmosphere. Environmental contamination of the atmosphere is substantially reduced.

A modification of the cleaning head has a rotatable porous sleeve mounted on a core rotatably supported on a cylindrical member. The sleeve has an external helical ribbon of abrasive material and porous material adjacent the ribbon. When the sleeve is rotated the ribbon of abrasive material horizontally and laterally scrubs the surface and distributes the cleaning liquid on the surface. The inside of the core and sleeve are subjected to vacuum which draws liquid and dirt through the sleeve into the cylindrical member. A hose connected to the cleaning head transports the liquid, air, and dirt to a vacuum pump and collection sump. A liquid dispenser located adjacent the sleeve directs a cleaning liquid onto the surface to be cleaned. The cleaning liquid dislodges and incorporates foreign material, such as dust, dirt, oils, grease, and particulates on the surface. The porous sleeve when rotated scrubs the surface and when subjected to vacuum picks up the foreign materials from the surface.

DESCRIPTION OF THE PREFERRED EMBODIMENTS OF THE SURFACE CLEANING APPRATUS OF THE INVENTION

Figure 1:
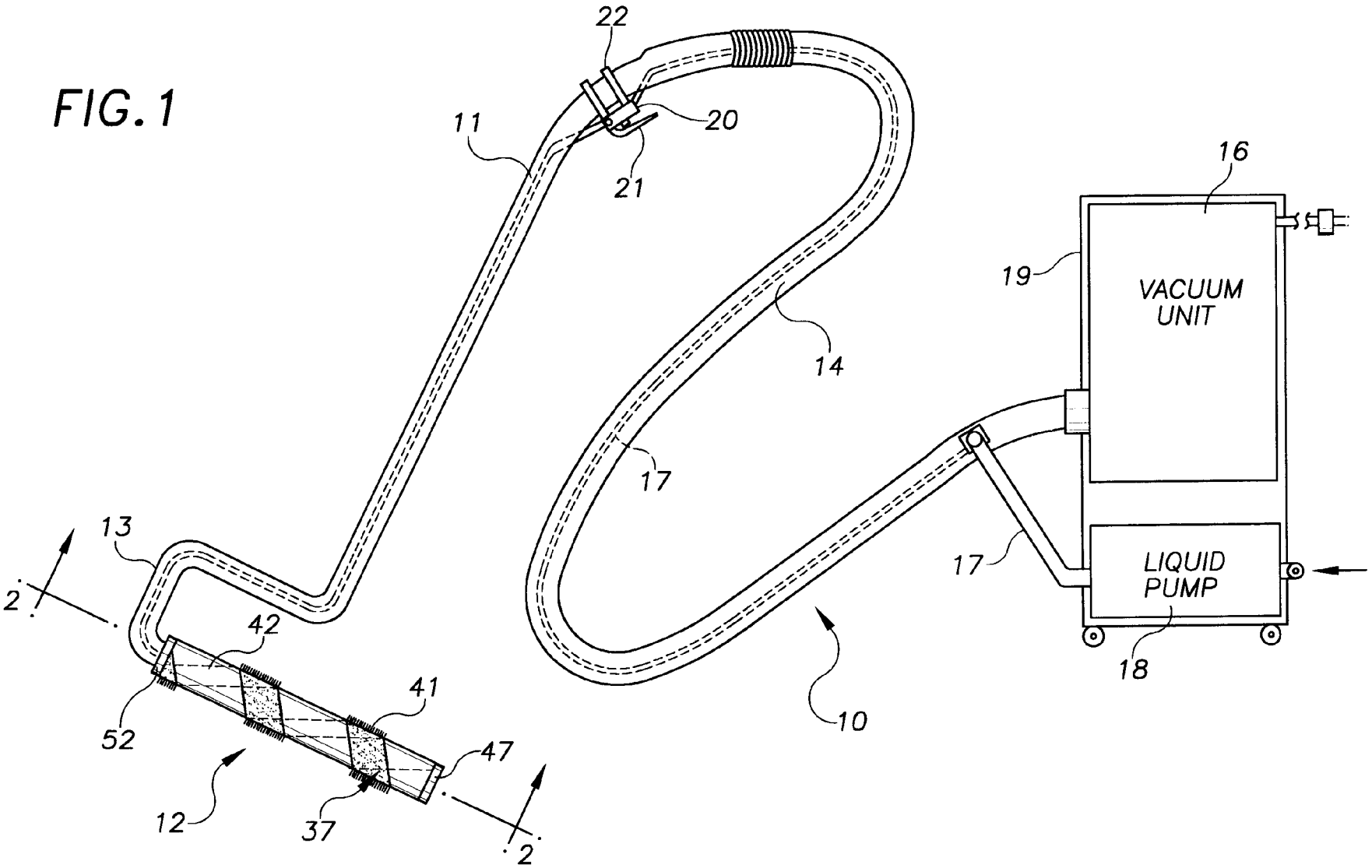
FIG. 1 is a perspective view of the surface cleaning apparatus of the invention connected to a vacuum unit and liquid pump.

The surface cleaning apparatus of the invention, indicated generally at 10 in FIG. 1, has an elongated linear tubular handle 11 connected to a cleaning head 12 with a U-shaped tubular neck 13. A flexible hose 14 connects the upper outlet end of handle 11 with a vacuum unit 16. Vacuum unit 16 has a motor driven blower used to draw air, molds, fungi, bacteria, pollen, dirt, oils, greases, liquid and particulates through cleaning head 12, neck 13, handle 11, and hose 14 and into vacuum unit 16. The air is discharged to atmosphere. The dirt, liquid, and particulates are collected in a tank, container or bag located in vacuum unit 16. Vacuum unit 16 is operable with a variable speed electric motor which controls the amount of vacuum pressure. Examples of vacuum unit 16 are a shop vacuum machine and the vacuum and liquid dispensing machine disclosed in U.S. Pat. No. 4,809,396.

A tube 17 for carrying liquids, such as water and cleaning solutions, is located within the passages of handle 11, neck 13 and hose 14. Tube 17 is an elongated flexible hose connected at one end to cleaning head 12 and at the opposite end to a liquid pump 18. Pump 18 operates to supply liquid under pressure to tube 17 at pressures in the range of 35 to 100 psi. The pressure of the liquid discharged by pump 18 can vary according to the conditions of the surface to be cleaned. The recommended maximum liquid pressure does not exceed 100 psi.

Vacuum unit 16 and liquid pump 18 are housed in a cabinet or housing 19 to facilitate transport of surface cleaning apparatus 10. Vacuum unit 16 and liquid pump 18 can be separate power equipment having individual controls for operating the equipment. Remote controllers can be used, by the work person to control the ON and OFF functions of vacuum unit 16 and liquid pump 18. ON and OFF switches associated with vacuum unit 16 and pump 18 are manually operated to control the operations of vacuum unit 16 and pump 18.

The flow of liquid in tube 17 is controlled with a valve assembly 20 interposed in tube 17 at the upper end of handle 11. A hand operated lever 21 is used by the work person to open valve assembly 20 to allow liquid to flow into cleaning head 12. A connector 22, such as a clamp, mounts valve assembly 20 on handle 11 in a location that is convenient for use by the work person. The valve assembly can be incorporated in a tubular section connecting handle 11 to hose 14.

Figure 2:
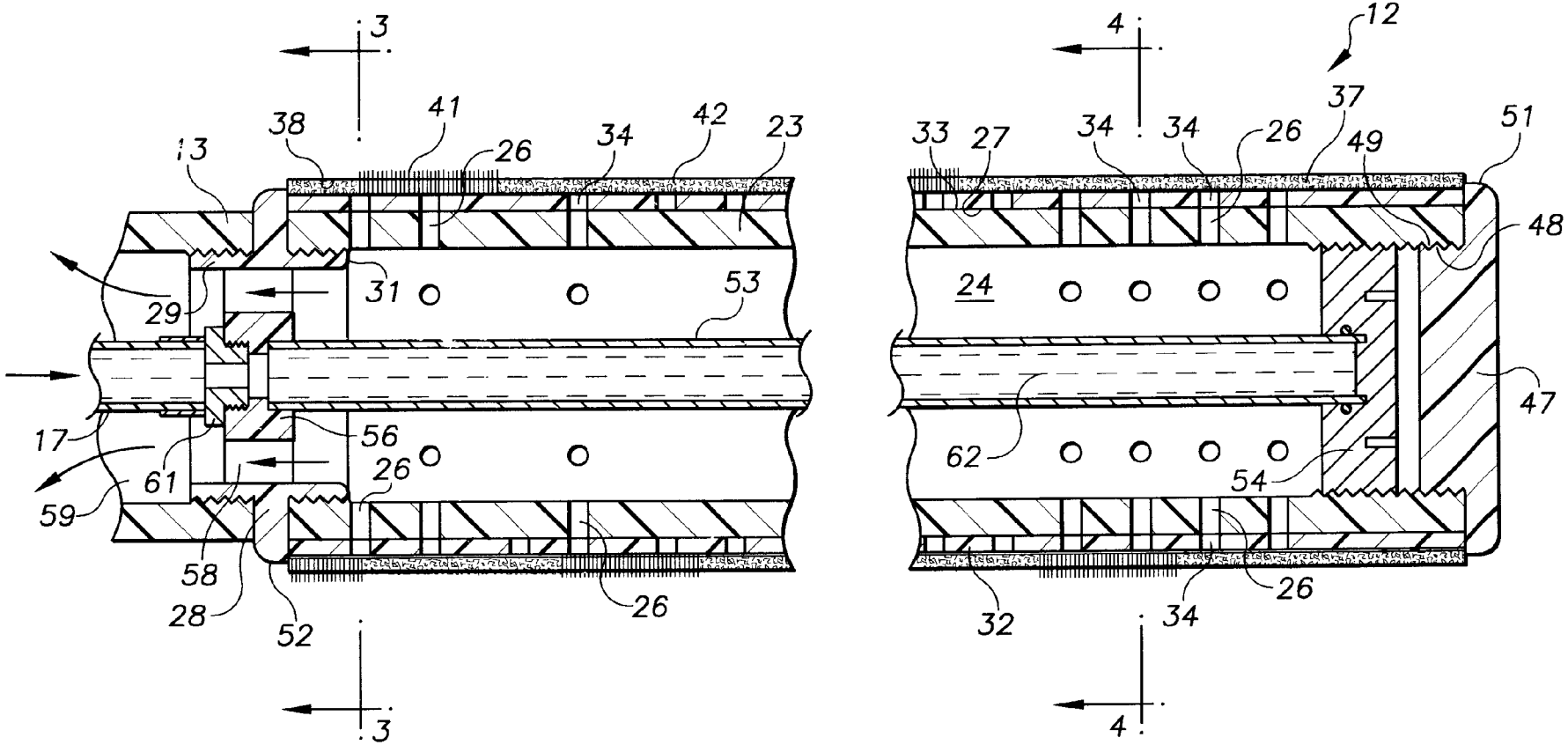
FIG. 2 is an enlarged and foreshortened sectional view taken along line 2—2 of FIG. 1.
Figure 4:
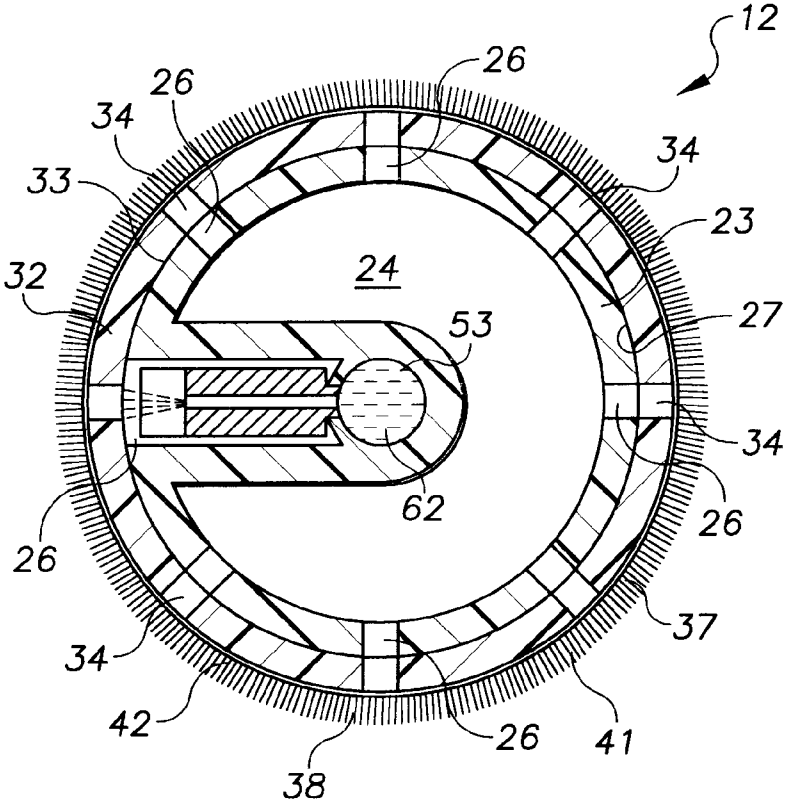
FIG. 4 is an enlarged sectional view taken along line 4—4 of FIG. 2.
Figure 3:
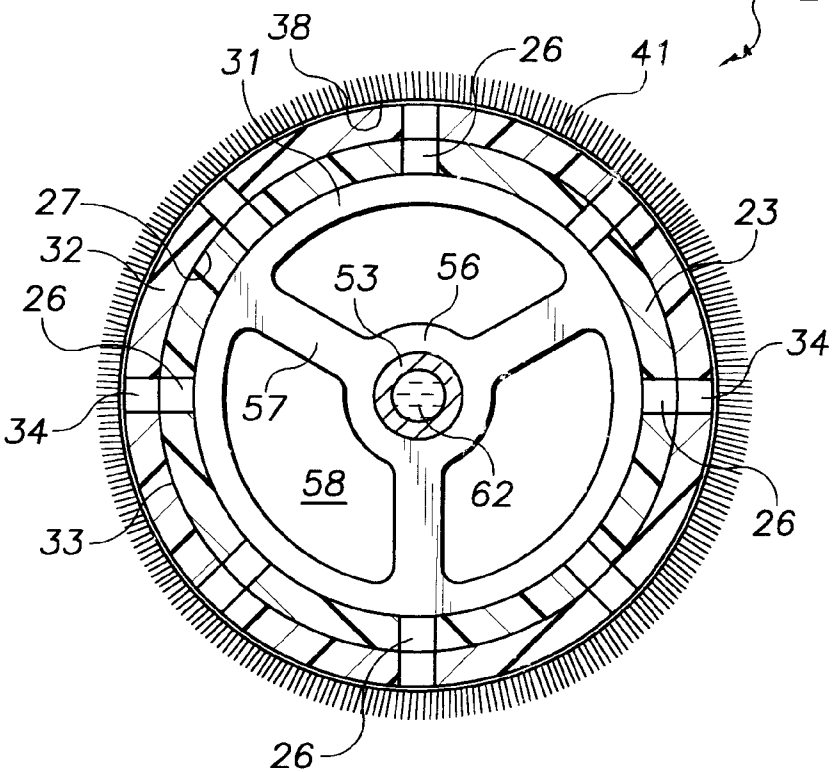
FIG. 3 is an enlarged sectional view taken along line 3—3 of FIG. 2.

Cleaning head 12, shown in FIGS. 2, 3 and 4, has a rigid cylindrical member 23 having an internal longitudinal chamber 24 and a plurality of rows of holes or orifices 26 located circumferentially around member 23. Holes 26 are open to chamber 24 and the cylindrical outer surfaces 27 of member 23. The number, size and locations of the holes can be changed to increase or decrease the flow of air, liquid, dust and dirt through member 23 into chamber 24 which flow through chamber 24, handle 11 and hose 17 to vacuum unit 16.

A connector 28 secures an end of member 23 to neck 13. Connector 28 has threaded annular portions 29 and 31 threaded into adjacent ends of neck 13 and member 23. Member 23 can be a linear extension of neck 13. Connector 28 can be replaced with an annular ring secured to the outside of member 23 to provide a shoulder 52 for a cylindrical core 32 positioned about member 23.

As shown in FIGS. 2 to 5, a cylindrical core 32 surrounding member 23 has a cylindrical inside surface 33 located in sliding surface engagement with the outer cylindrical surface 27 of member 23. Member 23 is a plastic tubular member having a low coefficient of friction, such as ultra high molecular weight polyethylene. This plastic material permits core 32 to freely rotate on member 23. Core 32 has rows of radial holes 34 circumferentially spaced from each other. The rows of holes 34 are laterally spaced along the length of core 32. Some of the rows of holes are radially aligned with the rows of holes 26 in member 23, as seen in FIGS. 2 to 4. Holes 34 are open to inside surface 33 and the outer cylindrical surface 36 to allow air and liquid to flow through core 32 into chamber 24.

A scrubber shown as a cylindrical sleeve, indicated generally at 37, is telescoped over core 32. Sleeve 37 has an inside cylindrical tube 38 of rigid material, such as plastic or paper, having a plurality of rows of spaced holes 39, shown in FIGS. 5, 11 and 13. The inside cylindrical surface of tube 38 is located in sliding surface engagement with the adjacent surface of core 32. The rows of holes 39 extend longitudinally along the length of tube 38. Holes 39 allow water and cleaning liquids to flow out of tube 38 and permit air, water, cleaning liquids, dust and dirt to be drawn into tube 38, through member 23 into chamber 24. A helical first ribbon 41 is wound about and secured to tube 38 with an adhesive or bonding material. Ribbon 41 is a band of abrasive material having uniform width and extends around tube 38 in an open helical pattern. Ribbon 41 is a flat porous pad of stiff plastic fibers, such as polypropane fibers, having abrasive properties. Other types of abrasive materials, including metal fibers, steel wool, sand paper, grit, emery cloth and natural materials can be used as abrasive ribbon 41. Ribbon 41 can also be outwardly directed fibers of tube 38. Ribbon 41 can be a combination of abrasive, absorbant and fiber materials. For example, ribbon 41 can have 45% plastic fibers, 45% absorbant material and 10% grit abrasive material. The space between ribbon 41 accommodates a helical second ribbon 42 of a flat porous material, such as a fabric, felt, artificial chamois, canvas, porous plastic and rubber like materials. Ribbon 42 is secured to tube 38 with an adhesive. Ribbons 41 and 42 cover the entire outer surface of tube 38 and extend between its opposite ends 43 and 44. As shown in FIGS. 2, 4, 5, and 9 to 13, first ribbon 41 has a continuous outer portion that projects outwardly from the level of the outer surface of second ribbon 42. First ribbon 41 has a radial thickness or dimension that is greater than the radial thickness or dimension of second ribbon 42. First ribbon 41 can be forced into contact with the surface during cleaning to enhance the scrubbing of the surface before second ribbon 42 engages the surface. The width of second ribbon 42 is greater than the width of first ribbon 41. An example of the scrubber is as follows. Cylindrical member 23 is a rigid paper cylinder having a length of 9 inches and an inside diameter of 1.5 inches. The wall of member is 1/16 inch thick. The holes in the wall each have a diameter of 1/32 inch. First ribbon 41 is an abrasive plastic fiber strip having a width of 1 inch and 2.5 helical turns around the outside surface of member 23. The second helical member is a sheet of artificial chamois having a width of 2 inches.

Sleeve 37 rolls on the surface to be cleaned and dislodges particulates, dirt, dust and films that collect on the surface.

Helical ribbon 41 has a combined longitudinal and lateral scrubbing and rubbing action on the surface as sleeve 37 rolls on the surface. Sleeve 37 also spreads water or cleaning liquids on the surface and allows a vacuum air flow to draw air, water, cleaning liquids longitudinally and laterally as sleeve 37 rolls forward and backward over the surface to effectively dislodge and remove dust, dirt, oils, and particulates from the surface.

Core 32 and sleeve 37 are retained in concentric relationship on cylindrical member 23 with an end cap 47 having a threaded boss 48. Boss 48 turns into threads 49 in the outer end of member 23. Cap 47 has an annular rim 51 that engages the ends of core 32 and sleeve 37. The opposite ends of core 32 and sleeve 37 engage an annular flange 52 joined to connector 28. Rim 51 and flange 52 restrict axial movement of core 32 and sleeve 37 on member 23 and allow substantially free rotation of core 32 and sleeve 37 on member 23. Cap 47 is removable from core 23 to allow sleeve 37 to be removed and replaced with a new sleeve.

Figure 6:
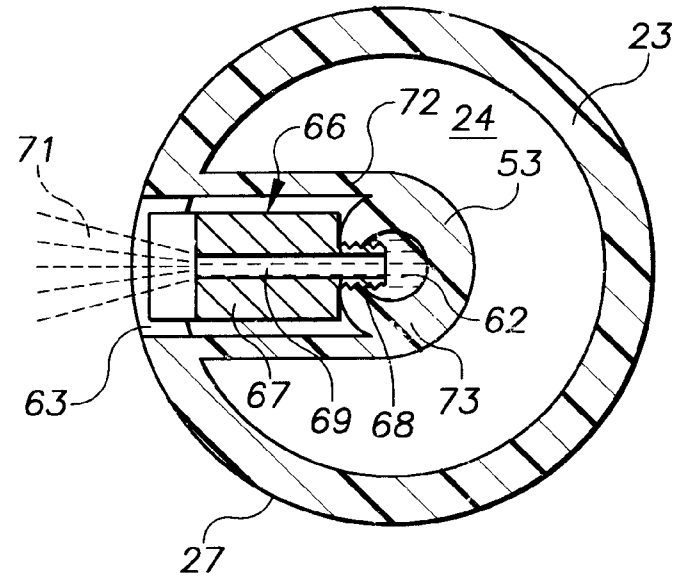
FIG. 6 is an enlarged sectional view taken along line 6—6 of FIG. 5.

Returning to FIGS. 2, 3 and 4, an elongated tube 53 in chamber 24 extends along the axis of cylindrical member 23. As shown in FIG. 6, linear horizontal walls 72 and 73 secure tube 53 to cylindrical member 23 on opposite sides of slot 63. Walls 72 and 73 prevent water and cleaning fluid from being dispensed directly into chamber 24. Nozzles 64 and 66 are isolated from chamber 24 whereby dirt and particulates drawn into chamber 24 does not collect on and render nozzles 64 and 66 inoperative. A plug 54 threaded into the outer end of member 23 holds and seals the end of tube 53. The opposite end of tube 53 is mounted on a central hub 56. Spokes 57 join hub 56 to connector 28. Spokes 57 are circumferentially spaced from each other and provide passages 58 between chamber 24 and a passage 59 in neck 13 to allow liquid and particulates to flow from chamber 24 into passage 59 and downstream through handle 11, hose 14, and into vacuum unit 16.

Figure 5:
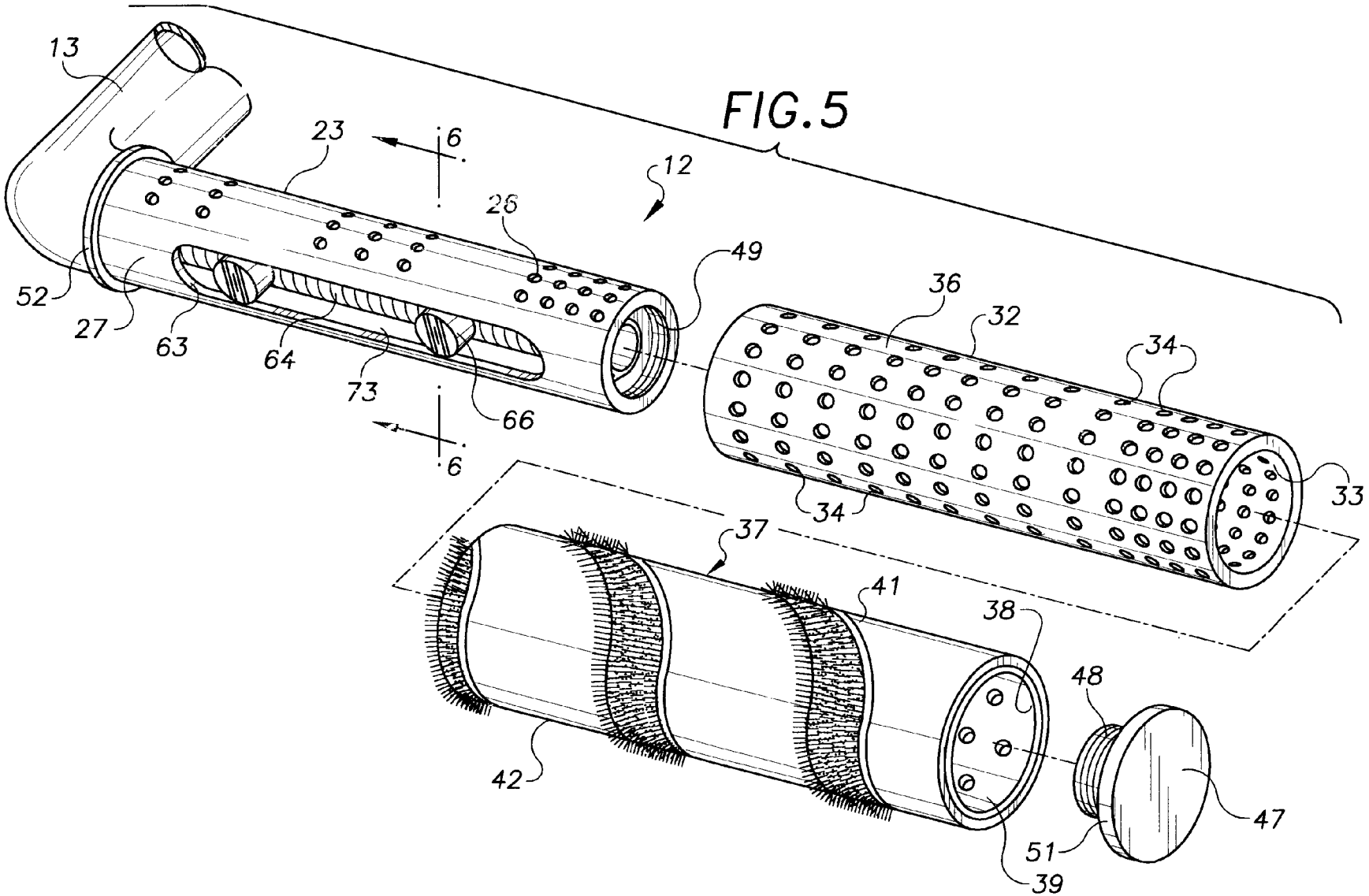
FIG. 5 is an exploded perspective view of the surface cleaning head shown in FIG. 1.

A coupling 61 connects tube 17 to hub 56 to direct liquid under pressure into passage 62. As shown in FIG. 5, tubular member 23 has a longitudinal slot 63 in the forward side of member 23. A pair of nozzles 64 and 66 secured to tube 53 project into slot 63. Nozzles 64 and 66 direct streams of liquid into holes 34 in core 32 and holes 39 in sleeve 37. Additional nozzles can be attached to tube 53 to increase the amount of liquid dispensed into holes 34 in core 32. The liquid flows into sleeve 37 through ribbons 41 and 42 which spreads the liquid on the surface to be cleaned.

Nozzles 64 and 66 are identical in structure and function. As shown in FIG. 6, nozzle 66 has a cylindrical body 67 joined to an end 68 threaded into tube 53. Body 67 and end 68 has a common passage 69 for carrying liquid from tube passage 62 and discharging the liquid toward core 32. Holes 34 in core 32 distribute the liquid along the length of sleeve 37. Liquid 71 is dispensed from nozzles 64 and 66 to the surface to be cleaned through holes 39 in sleeve 37 and porous ribbons 41 and 42 of sleeve 37. Valve assembly 20 is manually operated by the work person to control the flow of liquid to tube 53 and nozzles 64 and 66.

In use, the work person uses handle 11 to move cleaning head 12 over the surface to be cleaned. Hose 14 couples the upper end of handle 11 to vacuum unit 16 and tube 17 connects cleaning head 12 to pump 18. Vacuum unit 16 draws air through sleeve 37, core 32 and member 23. The flowing air picks up liquid, dirt, film and particulates from the surface and from sleeve 37. These materials are carried with the flowing air from chamber 24 through handle 11 and hose 14 to vacuum unit 16. Core 32 and sleeve 37 turn or rotate on cylindrical member 23 as cleaning head 12 is moved over the surface to be cleaned. The rotating ribbons 41 and 42 of sleeve 37 mechanically work the dirt, film, and particulates from the surface so that they can be incorporated with the cleaning liquid. The spaced helical ribbon 41 of abrasive material longitudinally and laterally scrubs the surface to be cleaned and works the dust, dirt, and particulates into the water and cleaning liquids. Helical ribbon 42 also has a longitudinal and lateral wiping and rubbing section on the surface to distribute water and cleaning liquids on the surface and pick-up water, cleaning liquids, dust, dirt, oils, and particulates from the surface. The air flowing through sleeve 37 and core 32 picks up the cleaning liquid, dirt, and particulates and carries them to vacuum unit 16. Vacuum unit 16 separates the air from the liquid, dirt, and particulates which are collected in a tank or container in vacuum unit 16. Valve assembly 20 is used by the work person to regulate the flow of liquid to nozzles 64 and 66 which discharge liquid into core 32 and sleeve 37. Cleaning head 12 can be used without the use of cleaning liquid to pick-up moisture from the surface.

Figure 8:
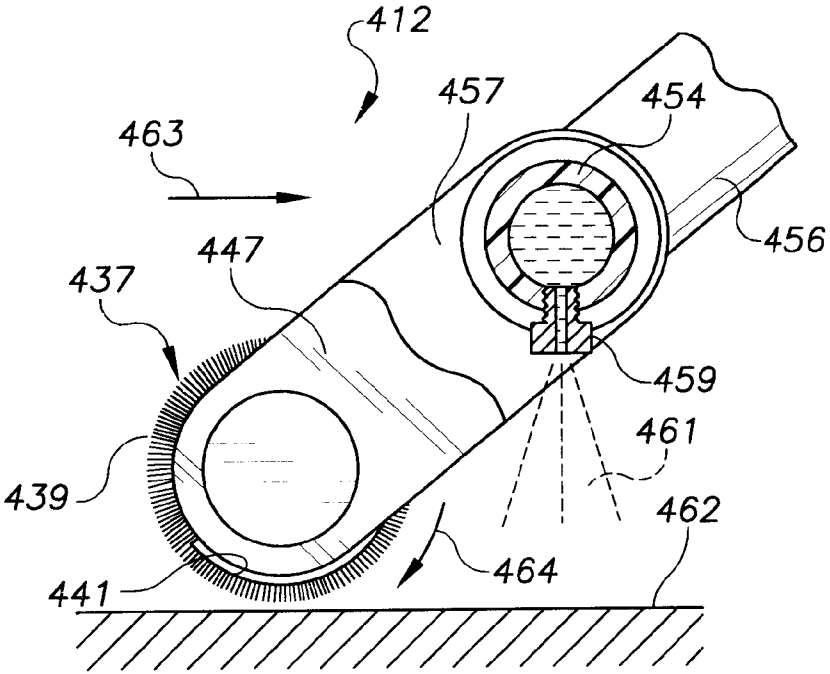
FIG. 8 is an enlarged sectional view taken along line 8—8 of FIG. 7.
Figure 7:
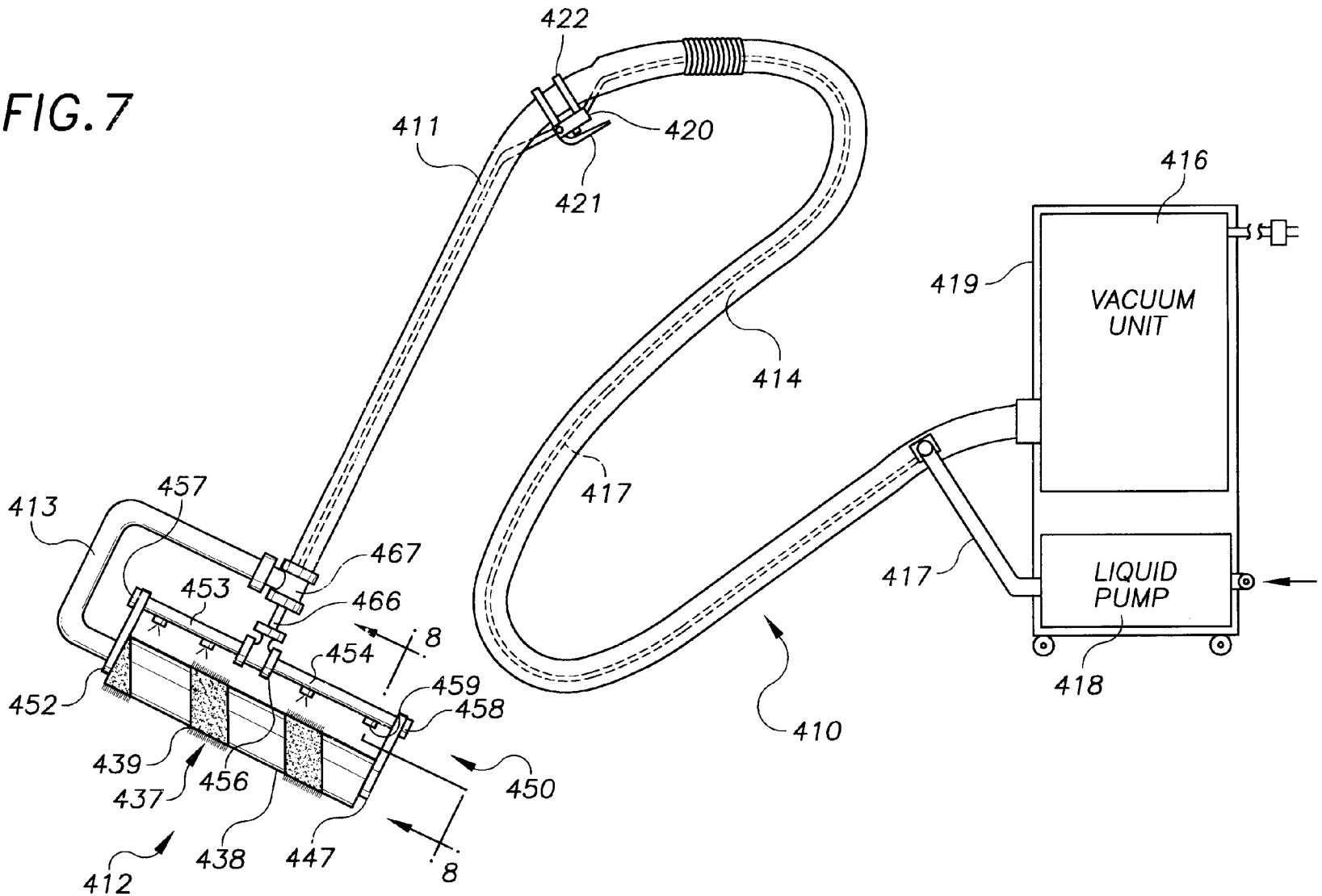
FIG. 7 is a perspective view of a first modification of the surface cleaning apparatus of the invention connected to a vacuum unit and liquid pump.
Figure 9:
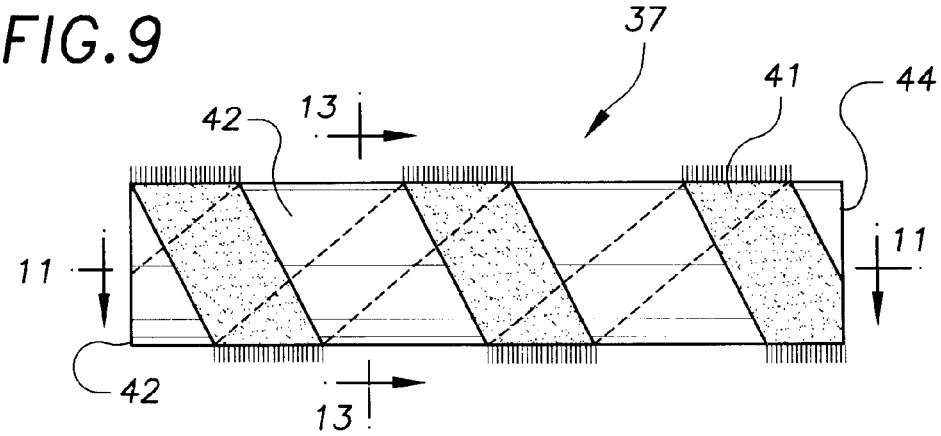
FIG. 9 is a front elevational view of the cylindrical sleeve for the cleaning heads shown in FIGS. 1 and 7.
Figure 10:
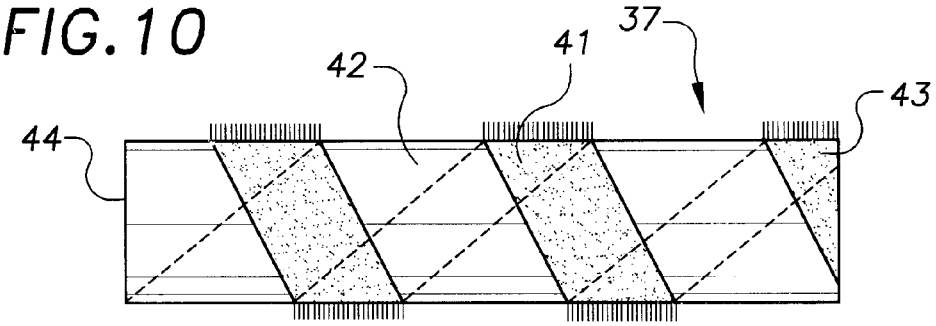
FIG. 10 is a rear elevational view of FIG. 9.
Figure 11:
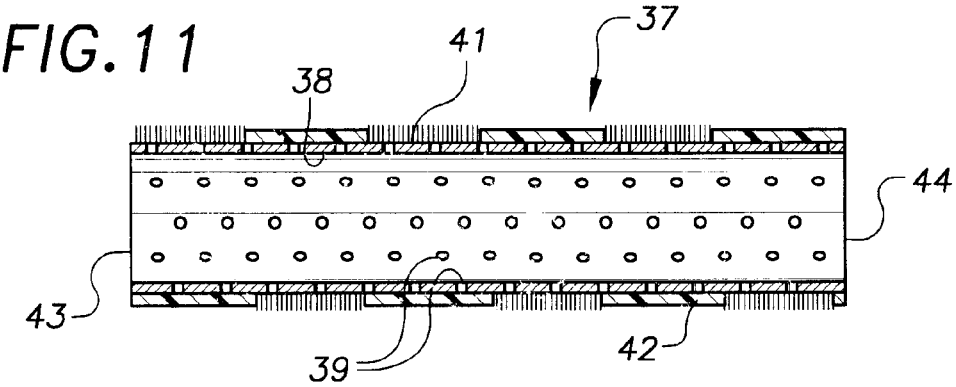
FIG. 11 is a sectional view taken along line 11—11 of FIG. 9.
Figure 12:
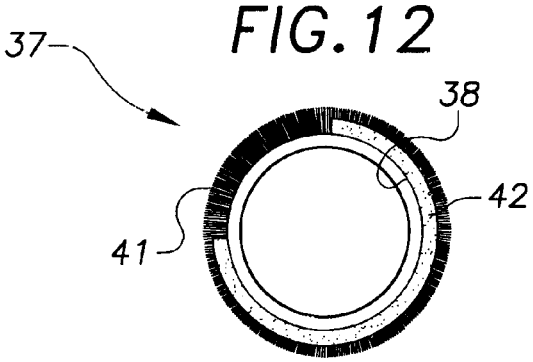
FIG. 12 is an end elevational view of the left end of FIG. 9.
Figure 13:
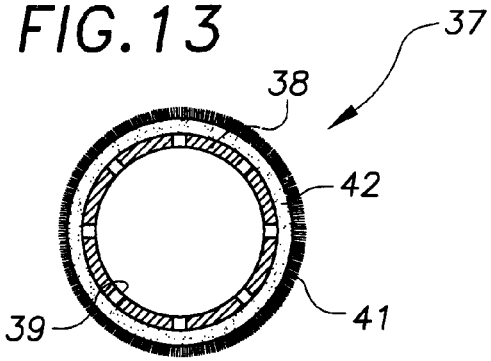
FIG. 13 is a sectional view taken along line 13—13 of FIG. 9.

A modification of the surface cleaning apparatus is shown in FIGS. 7 and 8. The surface cleaning apparatus indicated generally at 410 in FIG. 7, has an elongated linear tubular handle 411 connected to a cleaning head 412 with a U-shaped tubular neck 413. A flexible hose 414 connects the upper outlet end of handle 411 with a vacuum unit 416. Vacuum unit 416 has a variable speed motor driver blower used to draw air, molds, bacteria, fungi, pollen, dirt, liquid, and particulates through cleaning head 412, neck 413, handle 411, and hose 414 and into vacuum unit 416. The air is discharged to atmosphere. The dirt, liquid, and particulates are collected in a tank located in vacuum unit 416. Examples of vacuum unit 416 are a shop vacuum machine and the vacuum and liquid dispensing machine disclosed in U.S. Pat. No. 4,809,396.

A tube 417 for carrying liquids, such as water and cleaning liquids, is located within the passages of handle 411 and hose 414. Tube 417 is an elongated flexible hose connected at one end to cleaning head 412 and at the opposite end to a liquid pump 418. Pump 418 is operated to supply liquid under pressure to tube 417 at pressures to the range of 35 psi to 100 psi. The pressure of the liquid discharged by pump 418 can vary according to the conditions of the surface to be cleaned. The recommended maximum liquid pressure does not exceed 100 psi.

Vacuum unit 416 and liquid pump 418 are housed in a cabinet or housing 419 can be separate power equipment having individual controls for operating the equipment. Remote controllers can be used by the work person to control the ON and OFF functions of vacuum unit 416 and liquid pump 418. ON and OFF switches associated with vacuum unit 416 and pump 418 are manually operated to control the operations of vacuum unit 416 and pump 418.

The flow of liquid in tube 417 is controlled with a valve assembly 420 interposed in tube 417 at the upper end of handle 411. A hand operated lever 421 is used by the work person to open valve assembly 420 to allow liquid to flow toward cleaning head 412. A connector 422 mounts valve assembly 420 on handle 411 in a location that is convenient for the work person.

Cleaning head assembly 412 has the same structure as cleaning head 12 shown in FIGS. 2 to 4 except for the liquid carrying tube and nozzles within sleeve 437. Sleeve 437 has outer helical ribbons 439 and 441 that roll on the surface 462 to dislodge and pick-up liquid, dust, dirt, and particulates from the surface when sleeve 437 is subjected to vacuum. Sleeve 437 has the same structure as sleeve 37 shown in FIGS. 9 to 13 and described herein. Rotation of sleeve 437 on surface 462 provides helical ribbon 439 with a longitudinal and lateral wiping and rubbing action. The combined longitudinal and lateral scrubbing and wiping actions on surface 462 is effective to remove and pick-up dust, dirt, oils, and particulates from the surface.

A cleaning liquid dispenser 450 located adjacent sleeve 437 operates to discharge cleaning liquid 461 onto surface 462 in front of sleeve. As shown in FIG. 14, when cleaning head 412 is moved in the direction of arrow 463, sleeve 437 rotates in the direction of arrow 464. The air moving toward and into sleeve 437 picks up the liquid on surface 462 and dirt, dust, and particulates entrained in the air and liquid.

Liquid dispenser 450 has a pair of tubes 453 and 454 attached to a T coupling 456. The outer ends of tubes 453 and 454 extend through holes in arms 452 and 447. Caps 457 and 458 threaded on tube 453 and 454 close the ends of tubes 453 and 454 and retain tubes 453 and 454 on arms 452 and 447. Tubes 453 and 454 can be rotated to change the angular positions of nozzles 459 relative to sleeve 437 and the angle of liquid stream 461 relative to surface 462. The outer or lower ends of arms 447 and 452 are connected to the support member for sleeve 437.

Cleaning liquid from tube 417 flows through a tube 466 connected to T coupling 456 and a T coupling 467 joined to the lower end of handle 411. T coupling 456 is connected to tubular neck 413 so that air, liquid, dirt, and particulates flow from neck 413 to handle 411. The air flowing in hose 414 transports the liquid, dirt, and particulates to vacuum unit 416.

While there has been shown and described several embodiments of the surface cleaning apparatus of the invention, it is understood that changes in the parts and arrangement of parts and materials may be made by one skilled in the art without departing from the invention. For example, a device or one-way clutch, as disclosed by J. W. Noble in U.S. Pat. No. 2,949,620, can be used to limit rotation of the sleeve in one direction. The invention is defined in the following claims.

What is claimed is:

1. An apparatus for cleaning a surface comprising: an elongated tubular handle having a passage, a cleaning head connected to the handle, means for providing a vacuum to the passage of the tubular handle, tubular means for carrying a liquid located within the passage of the handle to the cleaning head, pump means connected to the tubular means operable to supply liquid under pressure to the tubular means, valve means connected to the tubular means for controlling the flow of liquid through the tubular means, said cleaning head having a rigid cylindrical first member with an internal chamber open to the passage in the handle, a plurality of first holes in the first member open to the chamber, means securing the first member to the handle, a cylindrical core rotatably mounted on the first member, a plurality of second holes in the core open to the first member, a scrubber located around said core, said scrubber having a rigid cylindrical second member telescoped over the core and rotatable with said core, said second member having third holes open to the second holes in the core, an open helical ribbon of abrasive material secured to said second member and projected radially outwardly from said second member, and a second helical ribbon of porous material located between the first ribbon secured to said second member and projected radially outwardly from said second member operable to dislodge particulates, dirt and films from a surface and allow air, liquid, particulates, dirt and films to move through the porous material into the internal chamber, a tube located in the internal chamber of the first member connected to the tubular means for accommodating liquid from the tubular means, means mounting the tube on the first member, nozzle means connected to the tube operable to direct liquid into the second holes in the core and third holes in the second member whereby at least the second ribbon spreads the liquid on the surface to be cleaned, said liquid on the surface being drawn through the scrubber along with air, particulates, dirt and films by the vacuum into the chamber of the cylindrical member and passage of the handle.

2. The apparatus of claim 1 wherein: the second ribbon has an outer surface, and said first ribbon has an outwardly projected outer portion.

3. The apparatus of claim 1 wherein: the first ribbon has a radial thickness, and the second ribbon has a radial thickness less than the radial thickness of the first ribbon.

4. The apparatus of claim 1 wherein: the first ribbon comprises a plastic fiber member having a radial thickness and a generally uniform width, and the second ribbon comprises a generally smooth porous member having a radial thickness smaller than the radial thickness of the first ribbon and a width greater than the width of the first ribbon.

5. The apparatus of claim 1 wherein: the first ribbon is a combination of materials comprising plastic fibers, grit abrasive material, and absorbant material.

6. An apparatus for cleaning a surface comprising: an elongated tubular handle having a passage, a cleaning head connected to the handle, means for providing a vacuum to the passage of the tubular handle, tubular means for carrying a liquid located within the passage of the handle of the cleaning head, pump means connected to the tubular means operable to supply liquid under pressure to the tubular means, valve means connected to the tubular means for controlling the flow of liquid through the tubular means, said cleaning head having a rigid cylindrical first member with an internal chamber open to the passage in the handle, a plurality of first holes in the first member open to the chamber, means securing the first member to the handle, a cylindrical core rotatably mounted on the first member, a plurality of second holes in the core open to the first member, a scrubber located around said core, said scrubber having a rigid cylindrical second member telescoped over the core and rotatable with said core, said second member having third holes open to the second holes in the core and an open helical ribbon surrounding and secured to the second member and projected radially outwardly from said second member operable to dislodge particulates, dirt and films from a surface and allow air, liquid, particulates, dirt and films to move through the porous material into the internal chamber, a tube located in the internal chamber of the first member connected to the tubular means for accommodating liquid from the tubular means, means mounting the tube on the first member, nozzle means connected to the tube operable to direct liquid into the second holes in the core and third holes in the second member whereby the ribbon spreads the liquid on the surface to be cleaned, said liquid on the surface being drawn through the scrubber along with air, particulates, dirt and films by the vacuum into the chamber of the cylindrical member and passage of the handle.

7. The apparatus of claim 6 wherein: the ribbon comprises plastic fibers having a generally uniform radial thickness and generally uniform width.

8. The apparatus of claim 6 wherein: the ribbon is a combination of materials comprising plastic fibers, grit abrasive material, and absorbant material.

9. The apparatus of claim 6 wherein: the ribbon is a band of abrasive material.

10. An apparatus for cleaning a surface comprising: a handle having a passage, a cleaning head connected to the handle, means for providing a vacuum to the passage of the handle, tubular means for carrying liquid to the cleaning head, pump means connected to the tubular means operable to supply liquid under pressure to the tubular means, liquid dispensing means connected to the tubular means to direct liquid on the surface to be cleaned, said cleaning head having a cylindrical member with an internal chamber open to the passage in the handle, first hole means in the cylindrical member open to the chamber, means securing the member to the handle, a cylindrical core rotatably mounted on the cylindrical member, said core having second hole means open to the cylindrical member to allow air and liquid to flow through the core, a porous scrubber having an open helical ribbon located around the core operable to horizontally and laterally dislodge particulates, dirt and film from the surface to be cleaned and allow air, liquid and particulates, dirt and films to move through the scrubber, said liquid on the surface being drawn through the scrubber along with air, particulates, dirt and films by the vacuum into the chamber of the cylindrical member and passage of the handle.

11. The apparatus of claim 10 wherein: the scrubber has third hole means to allow air, liquid, particulates, dirt and films to flow through the scrubber.

12. The apparatus of claim 10 wherein: the scrubber includes has a rigid cylindrical second member telescoped over the core and rotatable with said core, said second member having third hole means open to the second hole means in the core.

13. The apparatus of claim 12 wherein: the ribbon comprises plastic fibers having a generally uniform radial thickness and generally uniform width.

14. The apparatus of claim 12 wherein: the ribbon is a combination of materials comprising plastic fibers, grit abrasive material, and absorbant material.

15. The apparatus of claim 12 wherein: the ribbon is a band of abrasive material.

16. An apparatus for cleaning a surface comprising: a handle having a passage, a cleaning head connected to the handle, means for providing a vacuum to the passage of the handle, tubular means for carrying liquid to the cleaning head, pump means connected to the tubular means operable to supply liquid under pressure to the tubular means, liquid dispensing means connected to the tubular means to direct liquid under pressure to the tubular means, liquid dispensing means connected to the tubular means to direct liquid on the surface to be cleaned, said cleaning head having a cylindrical member with an internal chamber open to the passage in the handle, first hole means in the cylindrical member open to the chamber, means securing the member to the handle, a cylindrical core rotatably mounted on the cylindrical member, said core having second hole means open to the cylindrical member to allow air and liquid to flow through the core, a porous scrubber located around the core operable to horizontally and laterally dislodge particulates, dirt and film from the surface to be cleaned and allow air, liquid and particulates, dirt and films to move through the scrubber, said scrubber having a rigid second member telescoped over the core, said second member having third holes open to the core, an open helical first ribbon of abrasive material secured to said second member and projected radially outwardly from said second member, and a second helical ribbon or porous material located between the first ribbon and projected radially outwardly from said second member, said liquid on the surface being drawn through the scrubber along with air, particulates, dirt, and films by the vacuum into the chamber of the cylindrical member and passage of the handle.

17. The apparatus of claim 16 wherein: the second ribbon has an outer surface, and said first ribbon has an outwardly projected outer portion.

18. The apparatus of claim 16 wherein: the first ribbon has a radial thickness, and the second ribbon has a radial thickness less than the radial thickness of the first ribbon.

19. The apparatus of claim 16 wherein: the first ribbon comprises a plastic fiber member having a radial thickness and a generally uniform width, and the second ribbon comprises a generally smooth porous member having a radial thickness smaller than the radial thickness of the first ribbon and a width greater than the width of the first ribbon.

20. The apparatus of claim 16 wherein: the first ribbon is a combination of materials comprising plastic fibers, grit abrasive material, and absorbant material.

21. An apparatus for cleaning a surface comprising: a handle having a passage, means for providing a vacuum to the passage of the handle, a cleaning head connected to the handle, said cleaning head having a rigid first member with an internal chamber open to the passage in the handle, first hole means in the first member open to the chamber to allow air to flow through the first member, means securing the first member to the handle, a second member mounted on the first member, said second member being porous to allow air, liquid, particulates and dirt to flow through the second member into the chamber, at least one first helical ribbon of abrasive material secured to the second member for horizontally and laterally scrubbing the surface to be cleaned, nozzle means mounted on the first member located in the chamber operable to direct liquid into the first hole means and second member whereby the second member spreads the liquid on the surface to be cleaned, said liquid on the surface being drawn through the second member along with air, particulates and dirt by the vacuum into the chamber of the first member and passage of the handle.

22. The apparatus of claim 21 wherein: the ribbon comprises plastic fibers having a generally uniform radial thickness and generally uniform width.

23. The apparatus of claim 21 wherein: the ribbon is a combination of materials comprising plastic fibers, grit abrasive material, and absorbant material.

24. The apparatus of claim 21 wherein: the ribbon is a band of abrasive material.

25. The apparatus of claim 21 including: a helical second ribbon of porous material located adjacent said first ribbon secured to said second member for allowing air, liquid, particulates and dirt to flow through said second ribbon and second member into the chamber.

26. The apparatus of claim 25 wherein: the second ribbon has an outer surface, and said first ribbon has an outwardly projected outer portion.

27. The apparatus of claim 25 wherein: the first ribbon has a radial thickness, and the second ribbon has a radial thickness less than the radial thickness of the first ribbon.

28. The apparatus of claim 25 wherein: the first ribbon comprises a plastic fiber member having a radial thickness and a generally uniform width, and the second ribbon comprises a generally smooth porous member having a radial thickness smaller than the radial thickness of the first ribbon and a width greater than the width of the first ribbon.

29. The apparatus of claim 25 wherein: the first ribbon is a combination of materials comprising plastic fibers, grit abrasive material, and absorbant material.

30. An apparatus for cleaning a surface comprising: a handle having a passage, means for providing a vacuum to the passage of the handle, a cleaning head connected to the handle, said cleaning head having a rigid first member with an internal chamber open to the passage in the handle, first hole means in the first member open to the chamber to allow air to flow through the first member into the chamber, means securing the first member to the handle, a second member surrounding and mounted on the first member, said second member being porous to allow air, liquid, particulates and dirt to flow through the second member into the chamber of the first member, nozzle means mounted on the first member located in the chamber of the first member operable to direct liquid into the first hole means and second member whereby the second member spreads the liquid on the surface to be cleaned and scrubs said surface, said liquid on the surface being drawn into and through the second member along with air, particulates and dirt and through the hole means in the first member by the vacuum into the chamber of the first member and passage of the handle.

31. The apparatus of claim 30 including: second hole means in the second member to allow liquid, air, particulates and dirt to flow through the second member and through the hole means in the first member into the chamber of the first member.

32. A scrubber for a cleaning apparatus comprising: a rigid cylindrical member having an outer surface, an open helical first ribbon of abrasive material secured to the outer surface of the cylindrical member, and a second helical ribbon located between the first ribbon secured to the outer surface of the cylindrical member.

33. The scrubber of claim 32 wherein: said cylindrical member has a plurality of holes to allow air and liquid to flow through the cylindrical member.

34. The scrubber of claim 32 wherein: the second ribbon has an outer surface, the first ribbon has an outwardly projected outer portion.

35. The scrubber of claim 32 wherein: the first ribbon has a radial thickness, and the second ribbon has a radial thickness less than the radial thickness of the first ribbon.

36. The scrubber of claim 32 wherein: the first ribbon comprises a plastic fiber member.

37. The scrubber of claim 32 wherein: the second ribbon is a flat generally smooth porous member.

38. The scrubber of claim 32 wherein: the first ribbon comprises a plastic fiber member having a radial thickness and a generally uniform width, and the second ribbon comprises a generally smooth porous member having a radial thickness smaller than the radial thickness of the first ribbon and a width greater than the width of the first ribbon.

39. The scrubber of claim 32 wherein: the first ribbon is a combination of materials comprising plastic fibers, grit abrasive material, and absorbant material.

40. A scrubber for a cleaning apparatus comprising: a rigid cylindrical member having an outer surface and a plurality of holes through said member to allow air and liquid to flow through the member, and an open helical ribbon of abrasive material secured to the outer surface of the cylindrical member.

41. The apparatus of claim 40 wherein: the ribbon comprises plastic fibers having a generally uniform radial thickness and generally uniform width.

42. The apparatus of claim 40 wherein: the ribbon is a combination of materials comprising plastic fibers, grit abrasive material, and absorbant material.

43. The apparatus of claim 40 wherein: the ribbon is a band of abrasive material.

44. The apparatus of claim 40 including: a helical second ribbon of porous material located adjacent said first ribbon secured to said member for allowing air, liquid, particulates and dirt to flow through said second ribbon and member into the chamber.

45. The apparatus of claim 44 wherein: the second ribbon has an outer surface, and said first ribbon has an outwardly projected outer portion.

46. The apparatus of claim 44 wherein: the first ribbon has a radial thickness, and the second ribbon has a radial thickness less than the radial thickness of the first ribbon.

47. The apparatus of claim 44 wherein: the first ribbon comprises a plastic fiber member having a radial thickness and a generally uniform width, and the second ribbon comprises a generally smooth porous member having a radial thickness smaller than the radial thickness of the first ribbon and a width greater than the width of the first ribbon.

48. The apparatus of claim 44 wherein: the first ribbon is a combination of materials comprising plastic fibers, grit abrasive material, and absorbant material.

* * * * *